US007188025B2

(12) United States Patent
Hudson, Jr.

(10) Patent No.: US 7,188,025 B2
(45) Date of Patent: Mar. 6, 2007

(54) METHOD AND APPARATUS FOR EXCHANGING TRAFFIC CONDITION INFORMATION USING PEER TO PEER NETWORKING

(75) Inventor: Thomas Randall Hudson, Jr., Cary, NC (US)

(73) Assignee: International Business Machines Corporation, Armonk, NY (US)

( * ) Notice: Subject to any disclaimer, the term of this patent is extended or adjusted under 35 U.S.C. 154(b) by 411 days.

(21) Appl. No.: 10/739,679

(22) Filed: Dec. 18, 2003

(65) Prior Publication Data

US 2005/0137781 A1 Jun. 23, 2005

(51) Int. Cl.
*G06G 7/76* (2006.01)
*G08G 1/00* (2006.01)

(52) U.S. Cl. ..... 701/117; 701/118; 701/119; 701/200; 340/904

(58) Field of Classification Search ..... 701/117–119, 701/200; 340/901, 904, 907
See application file for complete search history.

(56) References Cited

U.S. PATENT DOCUMENTS 4,706,086 A 11/1987 Panizza ..... 340/902
5,428,544 A 6/1995 Shyu ..... 364/436
5,908,464 A * 6/1999 Kishigami et al. ..... 701/208
6,150,961 A * 11/2000 Alewine et al. ..... 340/995.1
6,169,495 B1 * 1/2001 Koike ..... 701/302
6,188,315 B1 * 2/2001 Herbert et al. ..... 340/438
6,246,932 B1 * 6/2001 Kageyama et al. ..... 701/24
6,333,703 B1 12/2001 Alewine et al. ..... 340/995
6,369,720 B1 4/2002 Wilhelm ..... 340/905
6,397,141 B1 5/2002 Binnig ..... 701/117
6,708,107 B2 * 3/2004 Impson et al. ..... 701/117
6,711,493 B1 * 3/2004 Andrews et al. ..... 701/117
2002/0030611 A1 * 3/2002 Nuesser et al. ..... 340/992
2002/0062190 A1 * 5/2002 Hameleers et al. ..... 701/117
2002/0198632 A1 12/2002 Breed et al. ..... 701/1
2003/0125845 A1 7/2003 Carlstedt et al. ..... 701/1
2003/0146850 A1 8/2003 Fallenstein ..... 340/901

FOREIGN PATENT DOCUMENTS

DE 10063598 6/2002

* cited by examiner

*Primary Examiner*—Y. Beaulieu
(74) *Attorney, Agent, or Firm*—Duke W. Yee; Martin J. McKinley; Gerald H. Glanzman

(57) ABSTRACT

A method, apparatus, and computer instructions for managing traffic information in a data processing system in a vehicle using peer to peer connections. A traffic situation is identified. A traffic data packet is generated in response to identifying the traffic situation. The traffic data packet includes traffic information and an area of influence. A traffic data packet is transmitted to another vehicle using a peer to peer connection based on a location of the vehicle with respect to the area of influence.

31 Claims, 5 Drawing Sheets

FIG. 1
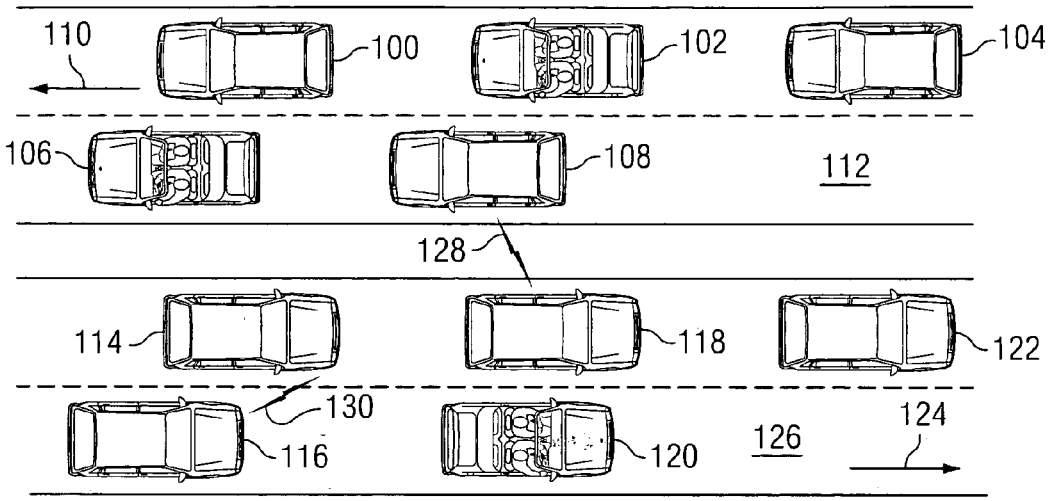
FIG. 2
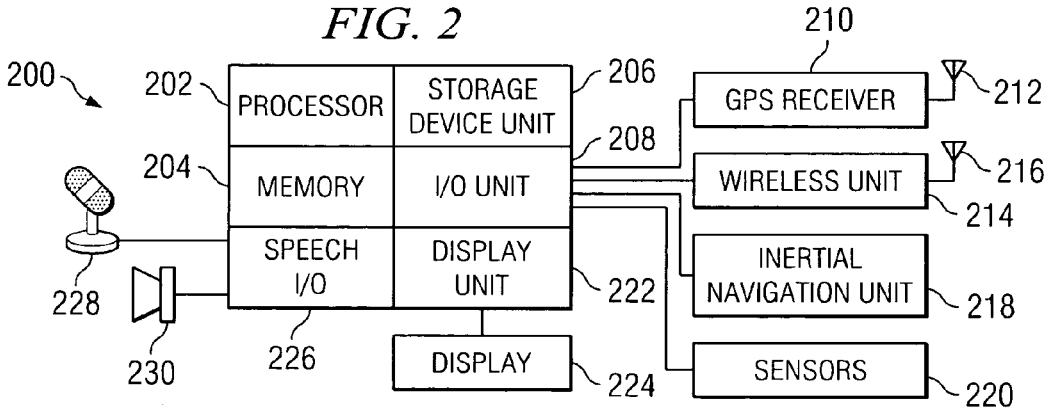
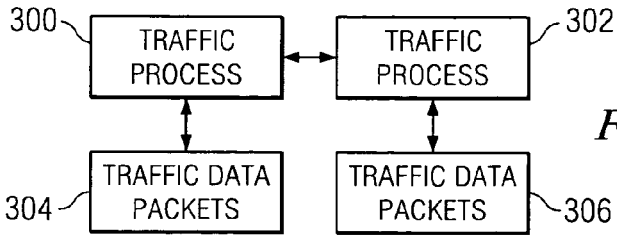
FIG. 3
FIG. 4
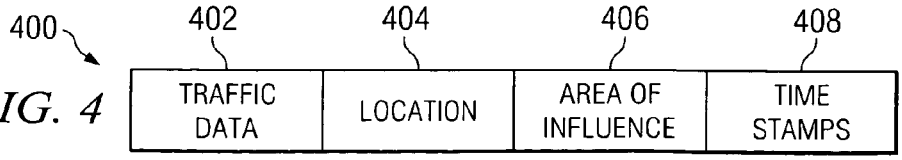

METHOD AND APPARATUS FOR EXCHANGING TRAFFIC CONDITION INFORMATION USING PEER TO PEER NETWORKING

BACKGROUND OF THE INVENTION

1. Technical Field

The present invention relates generally to an improved data processing system and in particular to a method and apparatus for collecting data. Still more particularly, the present invention relates to a method and apparatus for collecting and exchanging data regarding traffic conditions through wireless peer to peer networking in a distributed automotive computing system.

2. Description of Related Art

The use of computers has become more and more pervasive in society. This pervasiveness includes the integration of personal computers into vehicles. The utilization of computer technology is employed to provide users or drivers with a familiar environment. In this manner, a user's ability to easily use computing resources in an automobile is provided. In addition, it is envisioned that car buyers would be able to use most of the same software elements in an automobile that are used at home or in the office. Furthermore, an automobile owner could completely customize driver information displays to create an optimal environment for the driver's needs. Various platforms have been developed and are being developed for use in automobiles. Many platforms provide the computing strength of a personal computer platform with widely recognized and emerging technologies. Widely accepted technologies that may be implemented within an automobile include, cellular/global system for mobile communications (GSM), global positioning system (GPS), and radio data broadcast (RDB). These devices allow a driver to navigate, receive real-time traffic information and weather forecasts, access databases of personalized information, and place and receive telephone calls, as well as, send and receive email and faxes from an automobile. Emerging technologies that are being integrated into computing platforms for automobiles include the universal serial bus (USB) and the digital video disk (DVD).

Another key feature for adapting computer technologies for use in an automobile is a voice recognition interface (VRI) for the driver along with a more conventional graphical user interface (GUI) for passengers. Voice recognition technology is already well developed in multi-media desktop personal computers. For example, VoiceType family products available from International Business Machines Corporation may be also used in the automobile. Voice recognition technology would allow drivers to easily control and interact with onboard computers and telephone applications, including productivity software, internet browsers, and other applications while allowing the driver to keep their hands on the wheel and their eyes on the road.

Computing systems are currently being developed for automobiles to guide drivers from point A to point B using GPS data, traffic data, weather data, etc. Collecting all of this data, however, is a difficult job. It is especially difficult to collect this data in a timely manner. Therefore, it would be advantageous to have an improved method and apparatus for collecting data on traffic conditions.

SUMMARY OF THE INVENTION

The present invention provides a method, apparatus, and computer instructions for managing traffic information in a data processing system in a vehicle using peer to peer connections. A traffic situation is identified. A traffic data packet is generated in response to identifying the traffic situation. The traffic data packet includes traffic information and an area of influence. A traffic data packet is transmitted to another vehicle using a peer to peer connection based on a location of the vehicle with respect to the area of influence.

BRIEF DESCRIPTION OF THE DRAWINGS

The novel features believed characteristic of the invention are set forth in the appended claims. The invention itself, however, as well as a preferred mode of use, further objectives and advantages thereof, will best be understood by reference to the following detailed description of an illustrative embodiment when read in conjunction with the accompanying drawings, wherein:

FIG. 1 is a diagram illustrating data processing systems for exchanging traffic information in accordance with a preferred embodiment of the present invention;

FIG. 2 is a block diagram of an automotive computing platform in accordance with a preferred embodiment of the present invention;

FIG. 3 is a diagram illustrating traffic information in accordance with a preferred embodiment of the present invention;

FIG. 4 is a diagram illustrating a traffic data packet in accordance with a preferred embodiment of the present invention;

DETAILED DESCRIPTION OF THE PREFERRED EMBODIMENT

Figure 5:
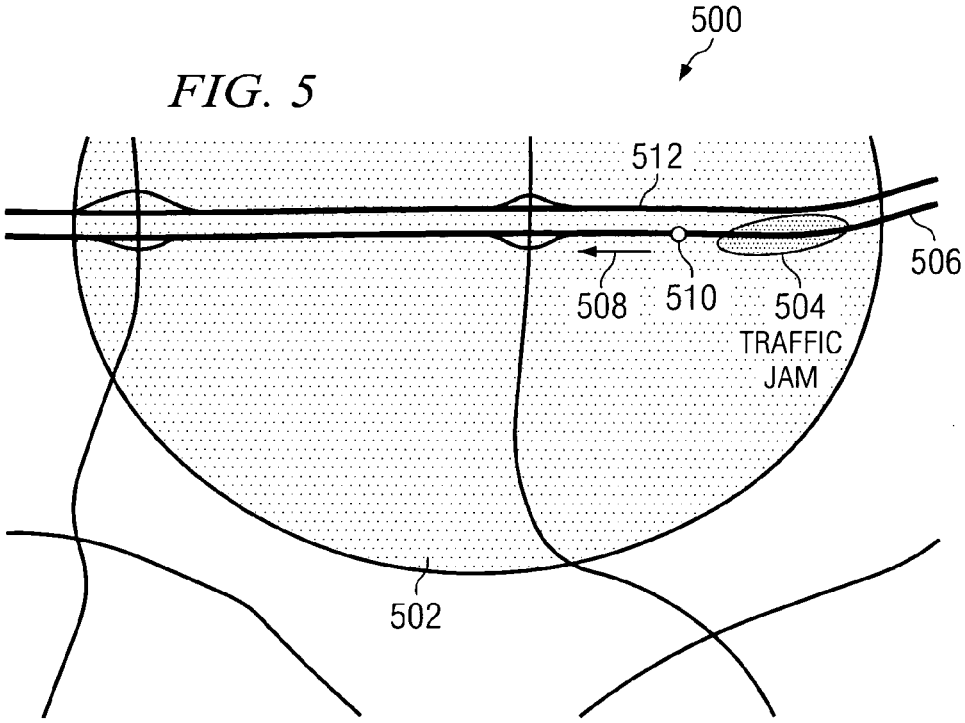
FIG. 5 is a diagram illustrating an area of influence in accordance with a preferred embodiment of the present invention.

With reference now to the figures and in particular with reference now to FIG. 1, a diagram illustrating data processing systems for exchanging traffic information is depicted in accordance with a preferred embodiment of the present invention. In these illustrative examples, the data processing systems are located in vehicles.

Automobiles 100, 102, 104, 106, and 108 are traveling in the direction of arrow 110 on road 112. Automobiles 114, 116, 118, 120, and 122 are traveling in the direction of arrow 124 on road 126. The data processing systems in these automobiles may collect information regarding traffic conditions. This information may be exchanged between the different data processing systems through peer to peer connections. For example, automobile 108 may provide automobile 118 traffic information regarding traffic conditions along road 126 through peer to peer connection 128. Similarly, automobile 114 may pass on traffic information to automobile 116 through peer to peer connection 130. In the illustrative examples, these peer to peer connections are all wireless peer to peer connections.

In these illustrative examples, each vehicle implementing the mechanism of the present invention gathers data through various sensors on the vehicle and may generate a traffic data packet containing information about the traffic condition. These traffic conditions may include various problems such as, for example, slow moving traffic, weather, and erratic driving conditions. These traffic data packets are stored in the data processing system and may be transmitted to other vehicles based on a policy or set of rules. The transmission occurs using a peer to peer connection.

In the illustrative embodiments, the wireless transmissions from the automobiles are short-range transmissions. These short-range transmissions may take various forms, such as, for example, very low power radio frequency (RF), wireless fidelity (Wi-Fi), and Bluetooth. Wi-Fi refers to a set of I.E.E.E. standards, 802.11a and 802.11b, for wireless transmissions. Bluetooth is a wireless personal area network (PAN) technology from the Bluetooth Special Interest Group. Bluetooth is an open standard for short-range transmission of digital voice and data between mobile devices (laptops, personal digital assistants (PDAs), phones) and desktop devices. This standard supports point-to-point and multipoint applications.

Additionally, these vehicles also include global positioning system (GPS) guidance systems. These systems allow for the data processing systems to identify their locations when data is received and identified as a traffic condition that should be shared with other vehicles.

Traffic information received by automobile 118 from automobile 108 may be passed onto other vehicles traveling along road 126. For example, automobile 118 may subsequently transmit the traffic information received from automobile 108 to automobiles 122 and 120 through peer to peer wireless connections.

Additionally, the exchange of traffic data packets is based on a location of the vehicle and an area of influence. The area of influence is an area of high probability in which the information in a traffic data packet will be useful to other vehicles. Further, these traffic data packets may be purged or discarded when the information is considered to be old or useless.

Turning next to FIG. 2, a block diagram of an automotive computing platform is depicted in accordance with a preferred embodiment of the present invention. Computing platform 200 is located within a vehicle, such as an automobile or truck. Computing platform 200 includes processor 202, which may be an embedded processor or a processor such as a Pentium processor from Intel Corporation. "Pentium" is a trademark of Intel Corporation. Computing platform 200 also includes memory 204, which may take the form of random access memory (RAM) and/or read only memory (ROM).

Computing platform 200 also contains a storage device unit 206. Storage device unit 206 may contain one or more storage devices, such as, for example, a hard disk drive, a flash memory, a DVD drive, or a floppy disk. Computing platform 200 also includes an input/output (I/O) unit 208, which provides connections to various I/O devices. In this example, a GPS receiver 210 is included within computing platform 200 and receives signals through antenna 212. Wireless unit 214 provides for two-way communications between computing platform 200 and another data processing system. Communications are provided through antenna 216. In addition, inertial navigation unit 218 is connected to I/O unit 208. Inertial navigation unit 218 is employed for navigation when GPS receiver 210 is unable to receive a usable signal or is inoperable.

A multitude of different sensors 220 also are connected to I/O unit 208. These sensors may include, sensors that detect speed, unusually high acceleration forces, airbag deployment, extensive speed up and slow down cycles, dropping out of cruise control, brake use, anti-lock brakes occurrences, traction control use, windshield wiper use, turning on or off of lights for the automobile, and outside light levels. In addition, sensors 220 may include sensors for detecting steering wheel movement, temperature, the state of door locks, and the state of windows. In other words, almost any condition or parameter about or around an automobile may be detected through the use of sensors 220. For example, these traffic conditions may include alerts regarding various hazardous road or weather conditions, such as ice or heavy rain. The detection of ice or heavy rain may be indicated through the number of times various computing units report the occurrence of the use of anti-lock brakes, traction control, or high speed windshield wiper use.

Computing platform 200 also includes a display unit 222, which is connected to display 224. In the depicted example, this display is a touch screen display. Alternatively or in addition to a touch screen display, display 224 also may employ a heads-up display projected onto the windshield of the automobile. Computing platform 200 also includes a microphone 228 and a speaker 230 to provide a driver with an ability to enter commands and receive responses through speech I/O 226 without having to divert the driver's attention away from the road, or without the driver having to remove the driver's hands from the steering wheel.

Processor 202 may generate a traffic data packet when data received from the different sensors are analyzed. Analysis of the data may indicate various traffic conditions. For example, data indicating excessive braking and slow speeds may indicate a traffic jam. In another example, data indicating the use of windshield wipers and engagement of an anti-lock braking system may indicate bad weather, such as rain or snow.

Detection of these conditions results in processor 202 generating a traffic data packet, which is stored and sent to other data processing systems in vehicles through a wireless peer to peer connection.

Turning now to FIG. 3, a diagram illustrating traffic information is depicted in accordance with a preferred embodiment of the present invention. Traffic process 300 and traffic process 302 are examples of processes that may be implemented in a computing platform, such as computing platform 200 in FIG. 2. Each of these processes is located on a computing platform in a vehicle. When information from sensors indicates a traffic condition that is to be propagated, traffic process 300 generates a traffic data packet describing that traffic condition. This traffic data packet is stored in traffic data packets 304. Traffic data packets 304 is a data store for traffic information. This data store may take various forms, such as, for example, a hard disk drive, a random access memory, or a nonvolatile memory.

When a peer to peer connection is established with traffic process 302, a handshake initially occurs in which the position of the vehicles and the vehicles destinations are exchanged between traffic process 300 and traffic process 302. The position of the vehicles is obtained through a GPS system in the illustrative examples. The destination is the destination selected by the user for the vehicle. This destination also may include an identification of a route, depending on the implementation. If the user has not selected a destination, the destination is a location that is an approximation of the vehicle's position at some selected time in the future. For example, the destination may be the vehicle's position 10 minutes from now. If the vehicle is traveling at 60 miles per hour, the destination is 6 miles down the current road on which the vehicle is traveling.

After the connection is established, traffic process 300 and traffic process 302 may exchange traffic data packets. The exchange may continue until all of the relevant traffic data packets are exchanged or until the connection is terminated because the vehicles in which these processes are located have moved out of range of each other.

In exchanging packets, the different traffic data packets in traffic data packets 304 are ranked or scored by traffic process 300. Traffic process 302 performs a similar procedure with traffic data packets stored in traffic data packets 306. In the illustrative examples, the traffic data packets are ranked or placed in an order of importance to allow sending of the most relevant traffic data packets first. In the event that the communications link between traffic process 300 and traffic process 302 is lost, the traffic data packets that are most likely to be of use will have them transferred first.

Additionally, traffic process 300 and traffic process 302 will selectively discard or purge traffic data packets. Traffic data packets that are considered to be too old are discarded. Additionally, traffic data packets in which the information is considered to be of no useful value are also discarded. A traffic data packet is considered too old if a selected period of time has passed since the traffic data packet has been created. The information in a traffic data packet is considered to be of no useful value when the packet leaves an area of influence created for the traffic data packet. This area of influence is described in more detail below with respect to the description of FIGS. 5 and 6.

Turning next to FIG. 4, a diagram illustrating a traffic data packet is depicted in accordance with a preferred embodiment of the present invention. Traffic data packet 400 is an example of a traffic data packet that may be located in traffic data packets 304 or traffic data packets 306 in FIG. 3. Traffic data packet 400 in this example includes traffic data 402, location 404, area of influence 406, and time stamps 408.

Traffic data 402 contains information identifying the traffic condition of interest as well as any details. For example, the traffic condition may be a traffic jam. The details may provide an average speed in the traffic jam. Location 404 contains the location of the traffic condition. This location may be identified through a GPS system, such as GPS receiver 210 in FIG. 2. The location information may be a coordinate for a map or may include a specific segment of a road.

Area of influence 406 contains data describing an area in which the traffic information in traffic data packet 400 will be useful to other vehicles. Area of influence 406 may take various forms, such as, for example, a circle, a cone, an ellipse, a square, a rectangle, or some other polygon shape. Area of influence 406 is selected based on factors such as whether the traffic condition described in traffic data 402 affects traffic moving in a single direction or in multiple directions.

Further, the size of area of influence 406 may depend on how long the traffic condition is expected to exist. For example, if the condition is a traffic jam occurring during a period of time that is statistically known for slow traffic, the area of influence may be selected such that traffic data packet 400 can be passed on to other vehicles for up to fifteen miles from the location of the traffic jam. Depending on the particular implementation, data in area of influence 406 in traffic data packet 400 may be unnecessary. This data may be inferred from traffic data 402 and location 404.

Time stamps 408 are initially set with a single time stamp when traffic data packet 400 is created. In the illustrative examples, the time stamp in time stamps 408 is set with the current time in milliseconds.

Traffic data packets may be merged if a data processing system in a vehicle receives a traffic data packet referring to the same traffic condition as another traffic data packet contained in the data processing system. Additional time stamps may be included in time stamps 408 if data from other traffic data packets are merged with traffic data packet 400. Typically, an expiration period is set based on some default value. When the period of time expires, traffic data packet 400 is discarded and no longer propagated to other data processing systems. When multiple time stamps are present in time stamps 408, the most recent time stamp is used in determining whether traffic data packet 400 is to be discarded. The time used for time stamps may be synchronized between vehicles in a number of different ways. For example, a current time may be transmitted through a wireless signal to the different vehicles. This signal may be, for example, a F.M. signal or a satellite signal, depending on the implementation.

Traffic data packet 400 also may be discarded when the location of the vehicle carrying traffic data packet 400 is no longer in the area defined by area of influence 406 in traffic data packet 400.

With reference next to FIG. 5, a diagram illustrating an area of influence is depicted in accordance with a preferred embodiment of the present invention. In this illustrative example, display 500 is an example of a map that is displayed on a display device, such as display 224 in FIG. 2.

In display 500, area of influence 502 is in the shape of a circle in this illustration. Area of influence 502 is derived from data in a data packet, such as data in area of influence 406 in traffic data packet 400 in FIG. 4. Traffic jam 504 is located along a portion of road 506 is display 500. Traffic flows along the direction of arrow 508 on road 506. Point 510 on road 506 is considered to be in front of the traffic condition, traffic jam 504. In this illustrative example, area of influence 502 is positioned in front of the traffic condition, traffic jam 504.

The size of area of influence 502 is calculated based on the average speed within the area encompassed by area of influence 502 and the amount of time remaining until the packet expires. In these examples, this average speed is identified using the speed limit for the segment of road at which the traffic condition is identified. For example, the default expiration time, such as 20 minutes, is multiplied by the designated speed limit for that segment of road to get the diameter of the circle for area of influence 502. For example, if road 506 has a speed limit of sixty miles per hour at the segment of road 506 where traffic jam 504 is identified and the traffic data packet has twenty minutes remaining until the traffic data packet expires, the size of area of influence 502 is selected to be twenty miles in diameter. As the amount of time remaining decreases, the size of area of influence 502 decreases.

Additionally, the location may change with time. In the illustrative examples, the location of area of influence 502 is selected such that the location is around one third to one half of its diameter being in front of the problem area, traffic jam 504.

Figure 6:
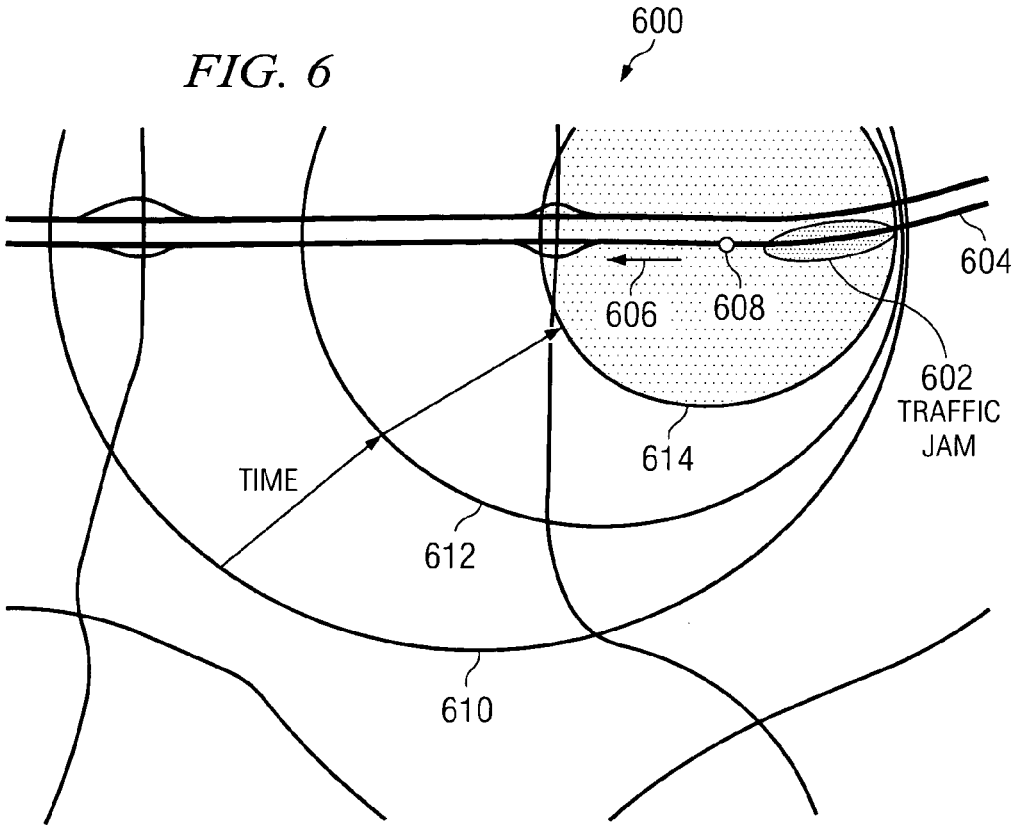
FIG. 6 is a diagram illustrating dynamic changes in an area of influence in accordance with a preferred embodiment of the present invention.

With reference next to FIG. 6, a diagram illustrating dynamic changes in an area of influence is depicted in accordance with a preferred embodiment of the present invention. In this illustrative example, display 600 is an example of a map that is displayed on a display device, such as display 224 in FIG. 2.

In this example, traffic jam 602 is located on road 604. Traffic moves along the direction of arrow 606 in these examples. Point 608 is considered to be in front of the traffic condition, traffic jam 602. The area of influence initially has an area encompassed by circle 610. As the expiration time for the traffic data packet approaches, the size and location of the area of influence are updated.

For example, as time passes the area of influence shrinks from the area and location encompassed by circle 610 to the area and location encompassed by circle 612. As additional time passes, the area of influence shrinks to the area and location encompassed by circle 614.

Figure 7:
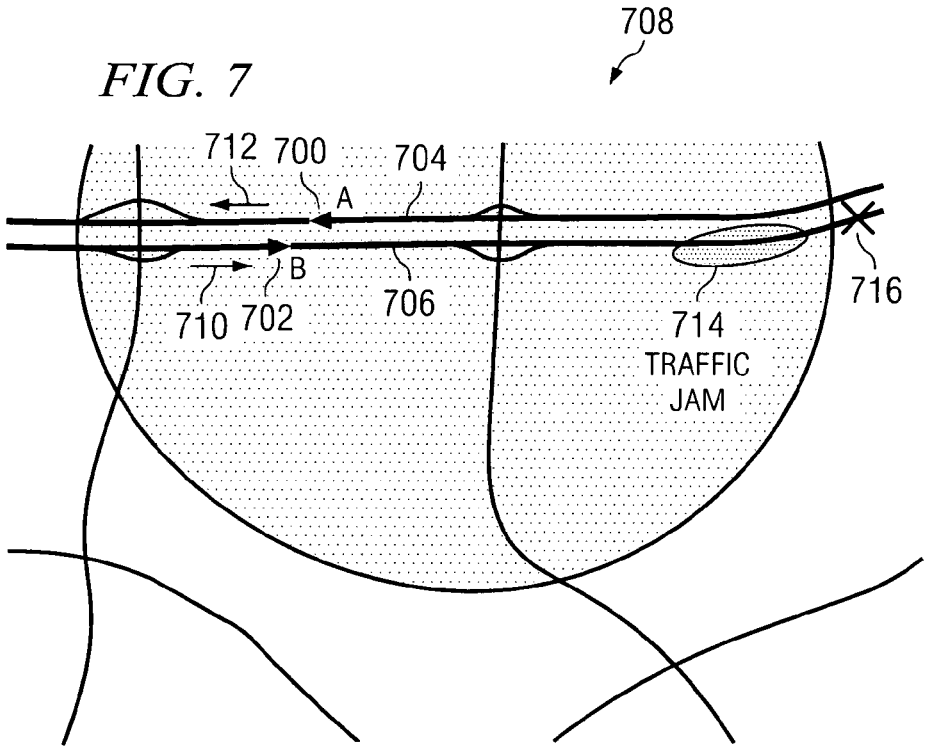
FIG. 7 is a diagram illustrating scoring of traffic data packets in accordance with a preferred embodiment of the present invention.
Figure 8:
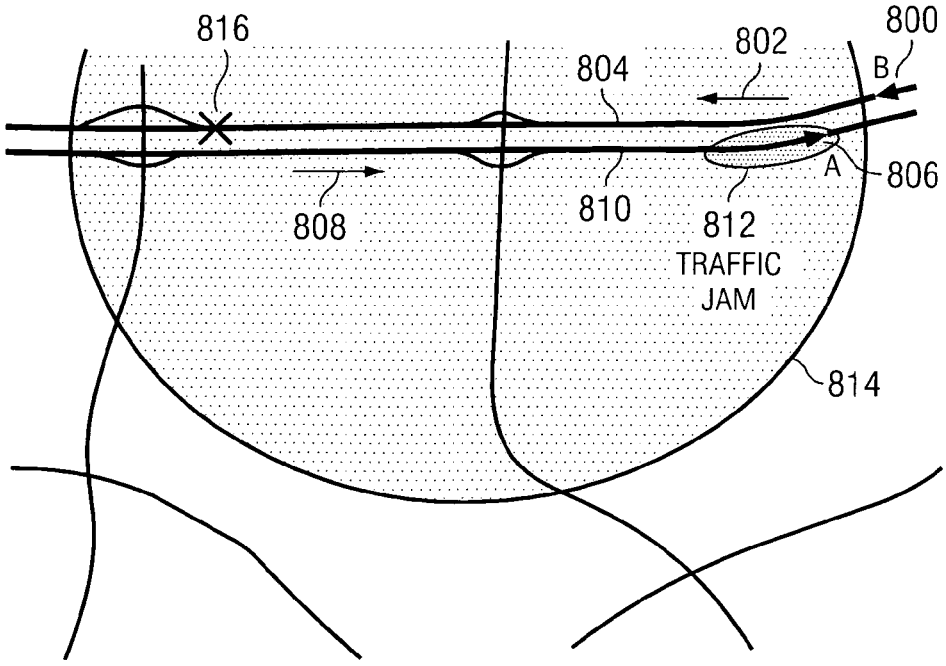
FIG. 8 is a diagram illustrating scoring of traffic data packets in accordance with a preferred embodiment of the present invention.

Turning next to FIGS. 7 and 8, diagrams illustrating scoring of traffic data packets is depicted in accordance with a preferred embodiment of the present invention. In these illustrative examples, the scoring is performed in two parts. FIG. 7 is used to illustrate the first part for scoring traffic data packets. The first part includes determining whether a traffic data packet is immediately useful to the other automobile, such as automobile B 702. In these illustrative examples, this score is weighted higher than the second part. For example, this score may be multiplied by 2.

In this example in FIG. 7, automobile A 700 and automobile B 702 are located on road 704 and road 706 in display 708. Automobile B 702 is traveling along the direction of arrow 710 on road 706 while automobile A 700 is traveling along the direction of arrow 712 on road 704. In this example, the traffic condition is traffic jam 714, which is located down the road from automobile B 702.

When two vehicles, such as automobile A 700 and automobile B 702, are exchanging traffic data packets, the traffic data packets exchanged between the two automobiles are performed by sending the most relevant packets first. In the event that communication is lost, the packets most likely to be of use to the other automobile or automobiles in that area will have been transferred first. This identification of most relevant packets is performed by sorting the traffic data packets based on their score. Automobile A 700 compares the traffic data packets in its datastore with current information for automobile B 702. In this example, the current information includes the location and destination of automobile B 702. In addition, automobile B 702 performs a similar process.

To calculate the first score, the immediate usefulness of a traffic data packet, the destination of automobile B 702 is compared to each traffic data packet problem location in this illustrative example. This location information is found within the traffic data packet and identifies the location at which the traffic location was identified. In this example, the traffic location is a location within traffic jam 714.

In these examples, the scores range from 0 to 100 The closer the two locations, the destination and the problem location, the higher the score. In this example, the traffic data packet carried by automobile A 700 contains information about traffic jam 714. This traffic data packets problem location is very close to the destination of automobile B 702, which is point 716 along road 706. Point 716 takes automobile B 702 through traffic jam 714. Therefore, this traffic data packet is one of the first traffic data packets exchanged. The distance may be measured in time by using the average speed limit in that area. The speed in that area is defined in these illustrative examples as the designated speed of the segment of road on which the problem occurs.

The second part includes calculating whether a traffic data packet is likely to remain inside the area of influence for the traffic data packet if this packet is transmitted to the other automobile. In this case, the traffic data packet may not be of immediate use, but this packet may help additional unknown automobiles. This calculation is illustrated in FIG. 8.

In FIG. 8, automobile B 800 is traveling along the direction of arrow 802 on road 804. Automobile A 806 is traveling along the direction of arrow 808 on road 810. Automobile A 806 is located in traffic jam 812 and generates a traffic data packet identifying this traffic condition. This traffic data packet has area of influence 814.

Automobile A 806 may establish a wireless peer to peer communications link with automobile B 800. In establishing this link, the destination at point 816 on road 804 is sent to automobile A 806 during the handshake. To calculate the second score, the traffic process in automobile A 806 compares area of influence 814 for the traffic data packet and the path that automobile B 800 will take to its destination location as defined by point 816. In this example, the path is along road 804 from the location of automobile B 800 to point 816. The greater the amount of intersection of this path and area of influence, the higher the score. Again, the score will range from 0 to 100. The amount of intersection can be measured in time or by distance.

In this case, automobile B 800 is a messenger vehicle. The path for automobile B 800 intersects a large portion of area of influence 814 for the traffic data packet. As a result, this traffic data packet obtains a high score, such as, for example, 90.

Figure 9:
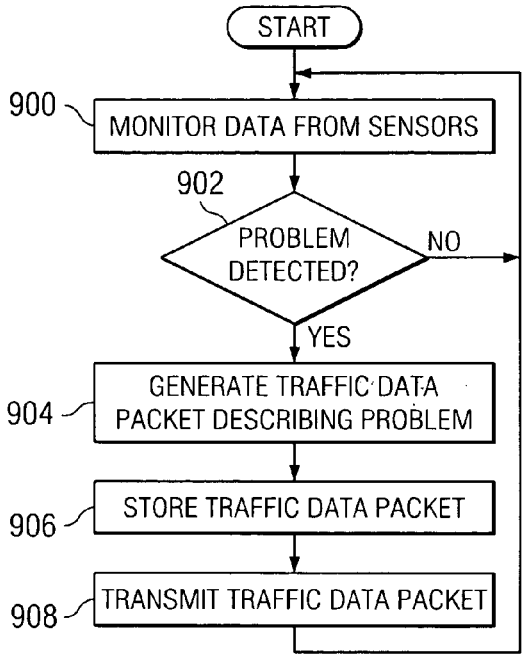
FIG. 9 is a flowchart of a process for generating traffic data packets in accordance with a preferred embodiment of the present invention.

Turning next to FIG. 9, a flowchart of a process for generating traffic data packets is depicted in accordance with a preferred embodiment of the present invention. The process illustrated in FIG. 9 may be implemented in a traffic process program or application, such as traffic process 300 in FIG. 3.

The process begins by monitoring data from sensors (step 900). These sensors include sensors, such as sensors 220 in FIG. 2. Next, a determination is made as to whether there is a problem detected (step 902). This problem detection is performed using the data from the sensors. Various types of analysis may be made depending on the particular type of implementation. For example, activation of an anti-lock braking system may indicate a slick surface from rain or ice. If the traffic data indicates slower than average speeds for the particular road along with frequent braking, a traffic condition, such as a traffic jam, may exist.

If a problem is detected, a traffic data packet is generated describing the problem (step 904). This traffic data packet may be generated and take the form of traffic data packets 304 in FIG. 3. Then, the traffic data packet is stored (step 906). In these examples, the traffic data packet is stored in a data store, such as, for example, traffic data packets 304 in FIG. 3. Next, the traffic data packet is transmitted using a wireless peer to peer connection (step 908), with the process then returning to step 900. Turning back to step 902, if a problem is not detected the process returns to step 900.

Figure 10:
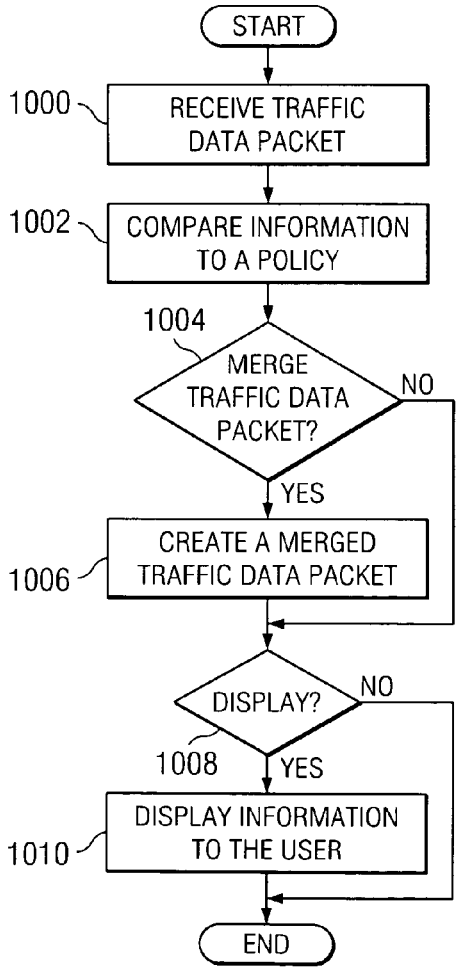
FIG. 10 is a flowchart of a process for processing a received traffic data packet in accordance with a preferred of the present invention.

In FIG. 10 a flowchart of a process for processing a received traffic data packet is depicted in accordance with a preferred of the present invention. The process illustrated in FIG. 10 may be implemented in a traffic process, such as traffic process 300 in FIG. 3.

The process begins by receiving a traffic data packet (step 1000). After the traffic data packet is received, the information is compared to a policy (step 1002). This policy may be, for example, a set of rules that determine how information is to be processed. For example, the policy may identify traffic conditions of interest that may be displayed to the user. This policy also may include rules to determine when a traffic data packet is to be discarded or merged with other traffic data packets. The particular rules and analysis depends on the particular implementation. The mechanism of the present invention may be used with any type of policy desired for generating or identifying traffic conditions.

Next, a determination is then made as to whether the traffic data packets should be merged (step 1004). This merger may be made if the traffic condition in the traffic data packet is the same as that for another traffic data packet. In other words, a determination is made as to whether the traffic information in the traffic data packet is for the same problem and location as another traffic data packet. If the packets are merged, a merged packet is created (step 1006). The merger of data in these examples includes combining the time stamps from each traffic data packet into the merged traffic data packet. With respect to combining time stamps, management of time stamps in a traffic data packet may be performed to avoid having the number of time stamps increase in an uncontrolled manner. For example, expired time stamps may be removed as well as removing time stamps when the number of time stamps grow beyond some selected number. In removing time stamps, these time stamps may be removed in first-in-first-out basis.

Further, when a merged packet is created, a higher confidence level in the traffic condition is present. Having different levels of confidence allows for filtering out false traffic conditions. Thereafter, a determination is made as to whether the packet is to be displayed (step 1008). This determination is based on the comparison of the traffic information received in a traffic data packet with the policy. For example, traffic information indicates that a traffic jam is ahead on the road on which the automobile is traveling, this traffic condition may be displayed to the user. This display may take various forms including, for example, display 500 in FIG. 5. With respect to merging traffic data packets, determining whether to display a traffic condition in step 1008, a traffic condition may be displayed only if two or more time stamps are present in the received traffic data packet. If the packet is not displayed, the process terminates.

Referring back to step 1008, if the traffic data packet is displayed, the traffic information is displayed to the user (step 1010). The process then terminates. In step 1004 if the traffic data packet is not merged, the process proceeds directly to step 1008 as described above.

Figure 11:
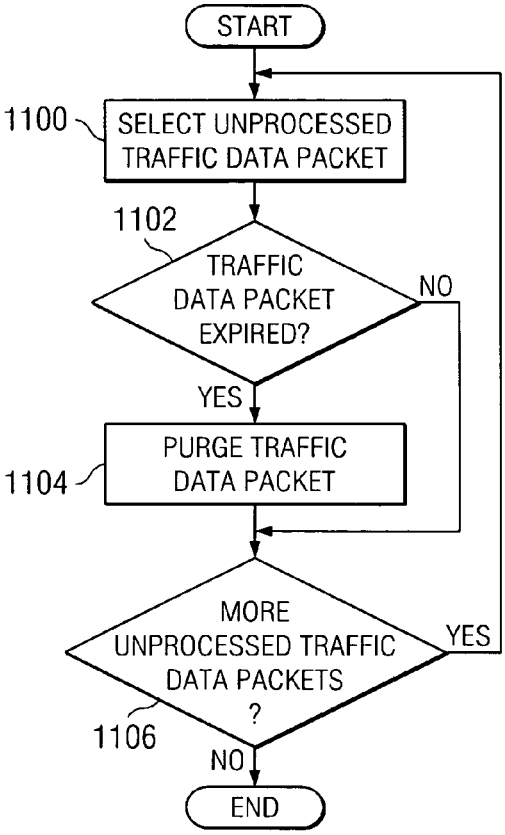
FIG. 11 is a flowchart of a process for managing traffic data packets in accordance with a preferred embodiment of the present invention.

Turning next to FIG. 11, a flowchart of a process for managing traffic data packets is depicted in accordance with a preferred embodiment of the present invention. The process illustrated in FIG. 11 may be implemented in a traffic process, such as traffic process 300 in FIG. 3.

The process begins by selecting an unprocessed traffic data packet (step 1100). The traffic data packet is selected from a set of traffic data packets located in a data store. Next, a determination is made as to whether the packet has expired (step 1102). A traffic data packet expires if a selected period of time has passed beyond the time stamp. Additionally, the traffic data packet is considered to have expired if the traffic data packet has moved outside the area of influence for the traffic data packet. Further, with respect to merged traffic data packets, the most recent time stamp is used in this determination.

If the traffic data packet has expired, the traffic data packet is purged (step 1104). Then, a determination is made as to whether more unprocessed traffic data packets are present in the data store (step 1106). If additional unprocessed packets are absent, the process terminates. However, if additional unprocessed traffic data packets remain, the process returns to step 1100 as described above. Turning back to step 1102, if the traffic data packet has not expired, then the process proceeds to step 1106 as described above.

Figure 12:
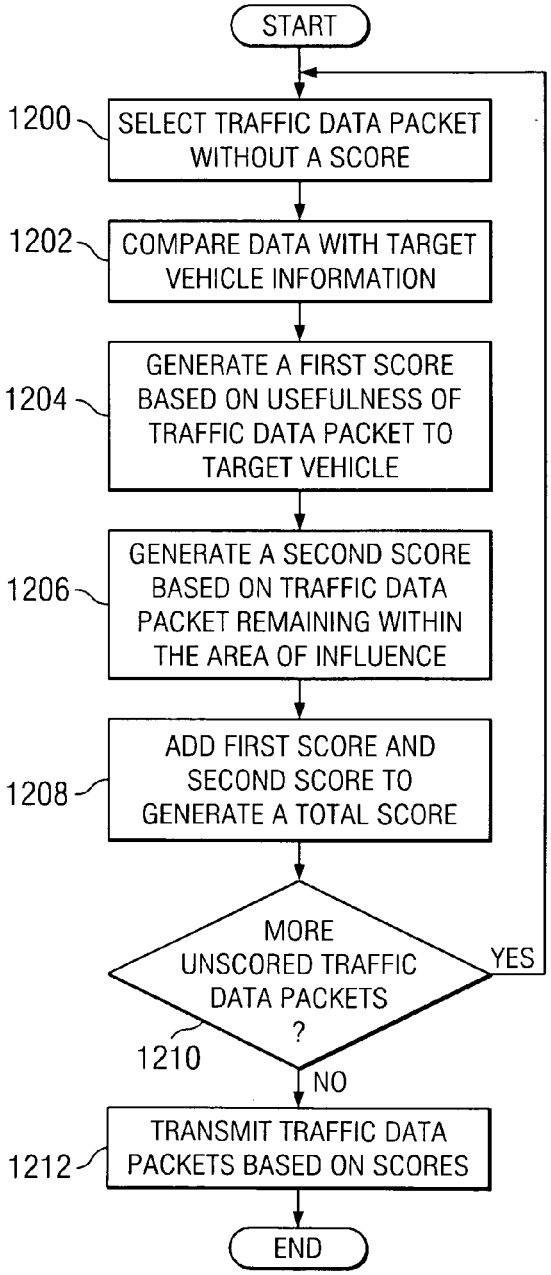
FIG. 12 is a flowchart of a process for adding scores to packets that currently do not have scores and transmitting them based on scores in accordance with a preferred embodiment of the present invention.

In FIG. 12 a flowchart of a process for adding scores to packets that currently do not have scores and transmitting them based on scores is depicted in accordance with a preferred embodiment of the present invention. The process illustrated in FIG. 12 may be implemented in a traffic process, such as traffic process 300 in FIG. 3.

The process begins by selecting a traffic data packet without a score (step 1200). Next, the data is compared with the target vehicle information (step 1202). The target vehicle information includes information exchanged during the handshake, establishing the wireless peer to peer communications link. Then, a first score is generated based on usefulness of the traffic data packet to target a vehicle (step 1204). The process then proceeds to generate a second score based on a traffic data packet remaining within the area of influence (step 1206).

Next, the first score and the second score are added to generate a total score (step 1208). Next, a determination is made as to whether there are more unscored traffic data packets remaining (step 1210). If more unscored traffic data packets are absent, then packets are transmitted based on scores (step 1212), with the process terminating thereafter. The transmission is made by sending traffic data packets in an order from the highest score to the lowest score. Turning back to step 1210, if more unscored packets are present, then the process returns to step 1200 as described above.

Thus, the present invention provides a method, apparatus, and computer instructions for exchanging traffic information between automobiles using a wireless peer to peer networking system. The mechanism of the present invention allows for traffic conditions to be propagated to different automobiles in a manner that allows for the traffic conditions to be sent to automobiles for which the information is relevant.

In these examples, the mechanism of the present invention is illustrated with respect to automobiles, but may be applied to other types of vehicles. For example, this mechanism may be used in motorcycles, trucks, and utility vehicles. Further, the mechanism of the present invention may be implemented in data processing systems used in vehicles other than those that are integrated into the vehicles. For example, the mechanism of the present invention may be implemented in a personal digital assistant (PDA) having a wireless transmission system and a GPS unit. In such a case, the PDA may be unable to generate traffic condition information, but is able to receive and propagate traffic data packets to other vehicles.

It is important to note that while the present invention has been described in the context of a fully functioning data processing system, those of ordinary skill in the art will appreciate that the processes of the present invention are capable of being distributed in the form of a computer readable medium of instructions and a variety of forms and that the present invention applies equally regardless of the particular type of signal bearing media actually used to carry out the distribution. Examples of computer readable media include recordable-type media, such as a floppy disk, a hard disk drive, a RAM, CD-ROMs, DVD-ROMs, and transmission-type media, such as digital and analog communications links, wired or wireless communications links using transmission forms, such as, for example, radio frequency and light wave transmissions. The computer readable media may take the form of coded formats that are decoded for actual use in a particular data processing system.

What is claimed is:

1. A method in a data processing system in a first vehicle for managing traffic information using peer to peer connections, the method comprising:

identifying a traffic situation;

responsive to identifying the traffic situation, generating a traffic data packet, wherein the traffic data packet includes a traffic information, and an area of influence, the area of influence comprising an area in which the traffic information included in the traffic data packet will be useful to another vehicle; and transmitting the traffic data packet to the another vehicle using a peer to peer connection based on a location of the first vehicle with respect to the area of influence.

2. The method of claim 1, wherein the data packet is discarded from the data processing system if the first vehicle leaves the area of influence.

3. The method of claim 1, wherein the traffic data packet includes an expiration and further comprising:

identifying the area of influence in accordance with an average speed in an area and an amount of time remaining until the expiration of the traffic data packet.

4. The method of claim 1, wherein a plurality of traffic data packets are stored in the data processing system and further comprising:

responsive to establishing a peer to peer connection with the another vehicle, selecting a first traffic data packet from the plurality of traffic data packets for transfer to the another vehicle.

5. A method in a data processing system in a first vehicle for managing traffic information using peer to peer connections, the method comprising:

identifying a traffic situation;

responsive to identifying the traffic situation generating a traffic data packet, wherein the traffic data packet includes a traffic information, and an area of influence; and transmitting the traffic data packet to another vehicle using a peer to peer connection based on a location of the first vehicle with respect to the area of influence, wherein a plurality of traffic data packets are stored in the data processing system and further comprising:

responsive to establishing a peer to peer connection with the another vehicle, selecting a first traffic data packet from the plurality of traffic data packets for transfer to the another vehicle, wherein the selecting step comprises:

generating a score based on usefulness of each traffic data packet in the plurality of traffic data packets and based on a probability of each traffic data packet remaining within the area of influence; and selecting the first traffic data packet as one having a highest score in the plurality of traffic data packets.

6. The method of claim 5, wherein the probability of each traffic data packet remaining within the area of influence is based on a destination of the another vehicle.

7. The method of claim 5, wherein each traffic data packet in the plurality of traffic data packets has a different area of influence.

8. The method of claim 1, wherein the area of influence is dynamic and changes in size as time passes.

9. The method of claim 1, wherein the area of influence is selected from one of a circle, a cone, a square, or a rectangle.

10. The method of claim 1 further comprising:

establishing the peer to peer connection with the another vehicle, wherein a present position and a destination are exchanged in a hand shake.

11. A data processing system in a first vehicle for managing traffic information using peer to peer connections, the data processing system comprising:

identifying means for identifying a traffic situation;

generating means, responsive to identifying the traffic situation, for generating a traffic data packet, wherein the traffic data packet includes traffic information and an area of influence, the area of influence comprising an area in which the traffic information included in the traffic data packet will be useful to another vehicle; and transmitting means for transmitting the traffic data packet to the another vehicle using a peer to peer connection based on a location of the first vehicle with respect to the area of influence.

12. The data processing system of claim 11, wherein the data packet is discarded from the data processing system if the first vehicle leaves the area of influence.

13. The data processing system of claim 11, wherein the traffic data packet includes an expiration and further comprising:

second identifying mean for identifying the area of influence in accordance with an average speed in an area and an amount of time remaining until the expiration of the traffic data packet.

14. The data processing system of claim 11, wherein a plurality of traffic data packets are stored in the data processing system and further comprising:

selecting means, responsive to establishing a peer to peer connection with the another vehicle, for selecting a first traffic data packet from the plurality of traffic data packets for transfer to the another vehicle.

15. A data processing system in a first vehicle for managing traffic information using peer to peer connections, the data processing system comprising:

identifying means for identifying a traffic situation;

generating means, responsive to identifying the traffic situation, for generating a traffic data packet, wherein the traffic data packet includes traffic information and an area of influence; and transmitting means for transmitting the traffic data packet to another vehicle using a peer to peer connection based on a location of the first vehicle with respect to the area of influence, wherein a plurality of traffic data packets are stored in them data processing system and further comprising:

selecting means, responsive to establishing a peer to peer connection with the another vehicle, for selection a first traffic data packet from the plurality of traffic data packets for transfer to the another vehicle, wherein the generating means is a first generating means and wherein the selecting means comprises:

second generating means for generating a score based on usefulness of each traffic data packet in the plurality of traffic data packets and based on a probability of each traffic data packet remaining within the area of influence; and means for selecting the first traffic data packet as one having a highest score in the plurality of traffic data packets.

16. The data processing system of claim 15, wherein the probability of each traffic data packet remaining within the area of influence is based on a destination of the another vehicle.

17. The data processing system of claim 15, wherein each traffic data packet in the plurality of traffic data packets has a different area of influence.

18. The data processing system of claim 11, wherein the area of influence is dynamic and changes in size as time passes.

19. The data processing system of claim 11, wherein the area of influence is selected from one of a circle, a cone, a square, or a rectangle.

20. The data processing system of claim 11 further comprising establishing means for establishing the peer to peer connection with the another vehicle, wherein a present position and a destination are exchanged in a hand shake.

21. A computer program product in a computer readable medium in a first vehicle for managing traffic information using peer to peer connections, the computer program product comprising:

first instructions for identifying a traffic situation;

second instructions, responsive to identifying the traffic situation, for generating a traffic data packet, wherein the traffic data packet includes traffic information and an area of influence, the area of influence comprising an area in which the traffic information included in the traffic data packet will be useful to another vehicle; and third instructions for transmitting the traffic data packet to the another vehicle using a peer to peer connection based on a location of the first vehicle with respect to the area of influence.

22. The computer program product of claim 21, wherein the data packet is discarded from the data processing system if the first vehicle leaves the area of influence.

23. The computer program product of claim 21, wherein the traffic data packet includes an expiration and further comprising:

fourth instructions for identifying the area of influence in accordance with an average speed in an area and an amount of time remaining until the expiration of the traffic data packet.

24. The computer program product of claim 21, wherein a plurality of traffic data packets are stored in the data processing system and further comprising:

fourth instructions, responsive to establishing a peer to peer connection with the another vehicle, for selecting a first traffic data packet from the plurality of traffic data packets for transfer to the another vehicle.

25. A computer program product in a computer readable medium in a first vehicle for managing traffic information using peer to peer connections, the computer program product comprising:

first instructions for identifying a traffic situation:

second instructions, responsive to identifying the traffic situation, for generating a traffic data packet, wherein the traffic data packet includes traffic information and an area of influence; and third instructions for transmitting the traffic data packet to another vehicle using a peer to peer connection based on a location of the first vehicle with respect to the area of influence, wherein a plurality of traffic data packets are stored in the data processing system and further comprising:

fourth instructions, responsive to establishing a peer to peer connection with the another vehicle, for selecting a first traffic data packer, from the plurality of traffic data packets for transfer to the another vehicle, wherein the fourth instructions comprises:

first sub-instructions for generating a score based on usefulness of each traffic data packet in the plurality of traffic data packets and based on a probability of each traffic data packet remaining within the area of influence; and second sub-instructions for selecting the first traffic data packet as one having a highest score in the plurality of traffic data packets.

26. The computer program product of claim 25, wherein the probability of each traffic data packet remaining within the area of influence is based on a destination of the another vehicle.

27. The computer program product of claim 25, wherein each traffic data packet in the plurality of traffic data packets has a different area of influence.

28. The computer program product of claim 2l, wherein the area of influence is dynamic and changes in size as time passes.

29. The computer program product of claim 2l, wherein the area of influence is selected from one of a circle, a cone, a square, or a rectangle.

30. The computer program product of claim 21 further comprising:

fourth instructions for establishing the peer to peer connection with the another vehicle, wherein a present position and a destination are exchanged in hand shake.

31. A data processing system in a first vehicle comprising:

a bus system a memory connected to the bus system, wherein to memory includes a set of instructions; and a processing unit connected to the bus system, wherein the processing unit executes a set of instructions to identify a traffic situation; generate a traffic data packet in response to identifying to traffic situation, wherein the traffic data packet includes traffic information and an area of influence, the area of influence comprising an area in which the traffic information included in the traffic data packet will be useful to another vehicle; and transmit the traffic data packet to the another vehicle using a peer to peer connection based on a location of the first vehicle with respect to the area of influence.

* * * * *